US012759772B2

(12) United States Patent
Schubert

(10) Patent No.: US 12,759,772 B2
(45) Date of Patent: Oct. 13, 2026

(54) TRANSFER PORT FOR TRANSFERRING A FLUID, AND TRANSFER SYSTEM

(71) Applicant: ATEC PHARMATECHNIK GMBH, Soerup (DE)

(72) Inventor: Peter Hans-Ludwig Schubert, Flensburg (DE)

(73) Assignee: ATEC PHARMATECHNIK GMBH, Soerup (DE)

( * ) Notice: Subject to any disclaimer, the term of this patent is extended or adjusted under 35 U.S.C. 154(b) by 137 days.

(21) Appl. No.: 18/832,514

(22) PCT Filed: Jan. 24, 2023

(86) PCT No.: PCT/DE2023/200018
§ 371 (c)(1),
(2) Date: Jul. 24, 2024

(87) PCT Pub. No.: WO2023/143678
PCT Pub. Date: Aug. 3, 2023

(65) Prior Publication Data

US 2025/0091777 A1 Mar. 20, 2025

(30) Foreign Application Priority Data

Jan. 26, 2022 (DE) ..... 10 2022 101 820.2

(51) Int. Cl.
*B65D 47/36* (2006.01)

(52) U.S. Cl.
CPC ..... *B65D 47/36* (2013.01)

(58) Field of Classification Search
USPC ..... 222/538
See application file for complete search history.

(56) References Cited

U.S. PATENT DOCUMENTS

2007/0088268 A1* 4/2007 Edwards ..... A61M 5/31501 604/151
2010/0224276 A1* 9/2010 Forrester ..... F16L 11/112 138/122

(Continued)

FOREIGN PATENT DOCUMENTS

DE 10 2020 124 826 A1 3/2022
EP 3 878 612 A1 9/2021
WO WO 2021/040983 A1 3/2021

OTHER PUBLICATIONS

H.-J. Baessler et al.: "Chapter 6—Aseptic Transfer Systems Into and Out of Barrier Isolators and RABS" Containment Technology, Springer-Verlag, Berlin Heidelberg, pp. 81-104 (2013).

*Primary Examiner* — Paul R Durand
*Assistant Examiner* — Michael J. Melaragno
(74) *Attorney, Agent, or Firm* — Norman B. Thot

(57) ABSTRACT

A transfer port includes a passage, a transfer hose arranged within the passage to guide a fluid, and an elastic spring element mechanically connected to the transfer hose. The transfer hose has an outlet end which can be removed from the passage so that it can be manipulated outside the passage and the fluid transferred through the passage via the outlet end. The transfer hose elastically pretensions the elastic spring element in this removal position and the elastic spring element is at least partially relaxed in a stowed position so that, via the elastic spring element, the transfer hose is pulled back from the removal position into the stowed position when the transfer hose, and thus the outlet end, is arranged within the passage. The transfer hose, in the stowed position, is arranged in the passage in a spiral, a helical, and/or a meandering manner via the elastic spring element.

16 Claims, 3 Drawing Sheets

(56) References Cited

U.S. PATENT DOCUMENTS

| | | | | |
|---|---|---|---|---|
| 2013/0180615 | A1* | 7/2013 | Ragner | F16L 11/115 138/119 |
| 2014/0130930 | A1* | 5/2014 | Ragner | D03D 3/06 138/121 |
| 2014/0130931 | A1* | 5/2014 | Forrester | F16L 11/118 156/143 |
| 2015/0007902 | A1* | 1/2015 | Ragner | D03D 3/02 138/121 |
| 2015/0041016 | A1* | 2/2015 | Ragner | F16L 11/12 138/121 |
| 2016/0054345 | A1* | 2/2016 | Watson | B65B 39/12 73/864.11 |
| 2022/0184599 | A1* | 6/2022 | Morrissey | B25J 21/005 |
| 2023/0234734 | A1 | 7/2023 | Bonhora et al. | |
| 2023/0364619 | A1 | 11/2023 | Krauss et al. | |
| 2025/0091777 | A1* | 3/2025 | Schubert | B65D 47/36 |

* cited by examiner

TRANSFER PORT FOR TRANSFERRING A FLUID, AND TRANSFER SYSTEM

CROSS REFERENCE TO PRIOR APPLICATIONS

This application is a U.S. National Phase application under 35 U.S.C. § 371 of International Application No. PCT/DE2023/200018, filed on Jan. 24, 2023, and which claims benefit to German Patent Application No. 10 2022 101 820.2, filed on Jan. 26, 2022. The International Application was published in German on Aug. 3, 2023 as WO 2023/143678 A1 under PCT Article 21(2).

FIELD

The present invention relates to a transfer port for transferring a fluid from a fluid reservoir into a receiving area through a passage arranged in a passage plane with a passage axis arranged substantially orthogonal to the passage plane and a transfer hose accommodated within the passage for guiding the fluid, wherein the transfer hose has an outlet end which can be pulled out of the passage from a stowed position within the passage into a removal position, so that the outlet end can be manipulated in the removal position outside the passage and the fluid can be transferred through the passage via the transfer hose via the outlet end, wherein the transfer hose has an elastic spring element which is mechanically connected to the transfer hose, wherein the transfer hose elastically pretensions the elastic spring element in the removal position and the elastic spring element is at least partially relaxed in the stowed position so that the elastic spring element causes the transfer hose to be retracted from the removal position into the stowed position when the transfer hose is released and the outlet end is thus arranged within the passage. The present invention also relates to a transfer system comprising a fluid reservoir, a receiving area, and a transfer port.

BACKGROUND

Known transfer ports for transferring a fluid, which are used, for example, in sterile technology for transferring liquids or gases, have a transfer hose which is, for example, concealed in a port connection and which can be removed after opening a port cover. Removing the transfer hose is usually simple and can also be performed, for example, robotically or using a gripper glove, however, problems always exist with stowing the transfer hose in the port, for example, so that a port cover can again be reliably closed. This can lead to problems such as the transfer hose becoming trapped inside the port cover when it is closed, in particular during an intervention using an intervention glove in a sterile container.

DE 10 2020 124 826 A1 describes a transfer port with a facility for transferring liquids. A hose can, for example, be removed from an isolation area via a robot and used to fill bottles. The hose is spring-loaded.

SUMMARY

An aspect of the present invention is to improve upon the prior art.

In an embodiment, the present invention provides a transfer port for transferring a fluid from a fluid reservoir to a removal area through a passage. The transfer port includes the passage which is arranged in a passage plane, a transfer hose which is arranged within the passage and which is configured to guide the fluid, and an elastic spring element which is mechanically connected to the transfer hose. The passage comprises a passage axis which is arranged substantially orthogonal to the passage plane. The transfer hose comprises an outlet end which is configured to be pulled out of the passage from a stowed position within the passage to a removal position outside the passage so that the outlet end can be manipulated in the removal position outside the passage and the fluid can be transferred through the passage via the outlet end of the transfer hose. The transfer hose elastically pretensions the elastic spring element in the removal position and the elastic spring element is at least partially relaxed in the stowed position so that, via the elastic spring element, the transfer hose is pulled back from the removal position into the stowed position when the transfer hose and thus the outlet end is arranged within the passage. The transfer hose, in the stowed position, is arranged in the passage in at least one of a spiral manner, a helical manner, and a meandering manner via the elastic spring element.

BRIEF DESCRIPTION OF THE DRAWINGS

The present invention is described in greater detail below on the basis of embodiments and of the drawings in which.

DETAILED DESCRIPTION

Figure 1:
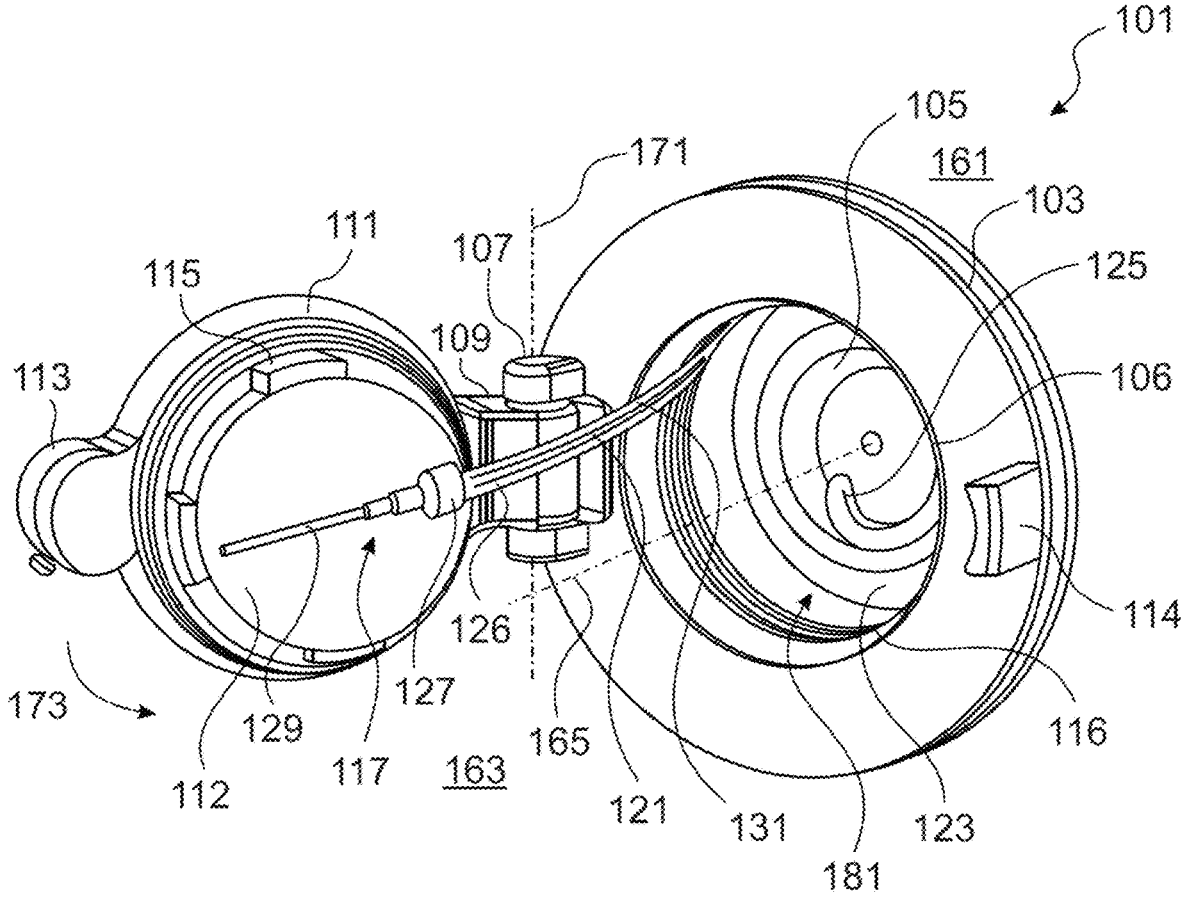
FIG. 1 is a schematic representation of a transfer port with a hose for transferring a fluid.
Figure 2:
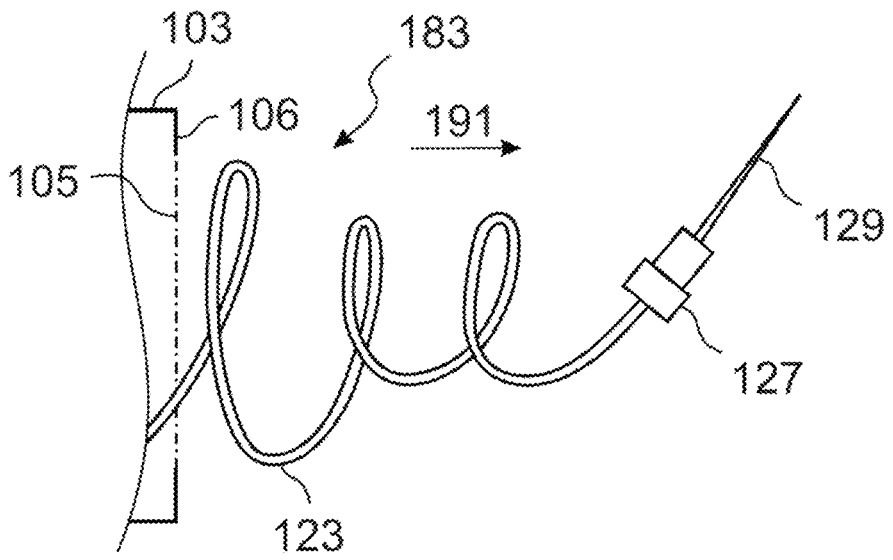
FIG. 2 is a schematic representation of the transfer port with the hose of FIG. 1, wherein a hose spiral is shown in a removal position.
Figure 3:
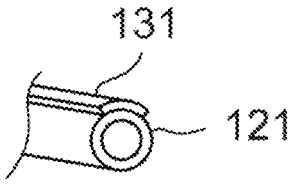
FIG. 3 is a schematic, partially sectional representation of the hose with a spiral spring.

The present invention provides a transfer port for transferring a fluid from a fluid reservoir into a receiving area through a passage arranged in a passage plane with a passage axis arranged substantially orthogonal to the passage plane and a transfer hose accommodated within the passage for guiding the fluid, wherein the transfer hose has an outlet end and can be pulled out of the passage from a stowed position within the passage into a removal position, so that the outlet end can be manipulated in the removal position outside the passage and the fluid can be transferred through the passage via the transfer hose via the outlet end, wherein the transfer hose has an elastic spring element mechanically connected to the transfer hose, wherein the transfer hose elastically pretensions the elastic spring element in the removal position and the elastic spring element is at least partially relaxed in the stowed position, so that, via the elastic spring element, a retraction of the transfer hose from the removal position into the stowed position is effected when the transfer hose is released and the outlet end is thus arranged within the passage, wherein the transfer hose in the stowed position is arranged in the passage in a spiral, helical and/or meandering manner, in particular in a spiral, helical and/or meandering manner within the passage plane, via the elastic spring element.

Due to the elastic spring element connected to the transfer hose, the elastic spring element is elastically pretensioned into a removal position when the transfer hose is removed and retracted towards a stowed position so that, for example, when the transfer hose or an area of the transfer hose that is necessary for transferring the fluid is released, the transfer hose is automatically retracted back into the area of the passage. This effectively prevents the transfer hose from jamming, for example, when the passage is closed and/or when the transfer port is closed.

In the stowed position, the transfer hose is arranged in the passage in a spiral, helical and/or meandering manner, in particular within the passage plane, via the elastic spring element. The transfer hose can thereby be accommodated in the stowed position in a space-saving manner and is returned to the respective shape via the elastic spring element and, for example, a corresponding design of the transfer hose, for example, via a corresponding geometry of the transfer hose or the elastic spring element, so that a reliable and trouble-free closing, for example, of a port cover, is enabled and provided.

The following terms are explained in this context:

A "transfer port", which is also called an "alpha-beta port", for example, or simply an "alpha port" or "beta port" as part of such a system, is in particular used for transferring objects and fluids in a sterile environment. Corresponding components of such a transfer port are usually designed to correspond to an opposite port so that a sterile transition between corresponding spaces is possible, for example, via a bayonet closure and also, for example, additional corresponding sealing planes. Such transfer ports and corresponding port systems are used in nuclear technology, in medical technology, and in the field of sterilization of objects. According to the present invention, such a transfer port is in particular used for transferring a fluid from a fluid reservoir, wherein the "fluid reservoir" is, for example, a tank or a bag in which a fluid, for example, a drug solution or a similar liquid, is received. The "transfer of a fluid" here takes place so that the fluid is, for example, transferred from one transfer port to another transfer port while the corresponding port parts are coupled together. This approach is, for example, used to fill medication vials, draw-up vials, and the like from a fluid reservoir, wherein sterility must be maintained.

The "removal area" is the area into which the fluid is transferred, wherein, for example, a receptacle for corresponding draw-up vials or filling vessels is here arranged so that, for example, an automated or semi-automated filling of liquids is also possible. A "passage plane" here refers to the transfer plane that is formed between the corresponding port components, wherein this plane does not need to be mathematically precisely determinable, but is defined in essence, for example, by a contact face, in particular a contact ring, of corresponding port components against each other and tolerates deviations of a position in the technically required range. This means that the passage plane in particular lies in an envelope area of the respective transfer port or an arrangement of coupled transfer ports. A "passage" is thus formed in the passage plane, i.e., a free space for a transfer to pass through. A "passage axis" here refers to a longitudinal axis that is substantially orthogonal to the passage plane and thus defines a direction in which the transfer or along which the transfer of media such as the fluid takes place. The expression "substantially orthogonal" refers to a technically conditional definition of orthogonality, wherein deviations of +15° to −15° may here be permissible, for example, if a corresponding transfer port is arranged at an angle, for example, at the angle mentioned, within a surrounding wall. Other angles are here possible within the scope of technical embodiments. Angle specifications here refer to a full angle of 360°.

A "transfer hose" is, for example, a plastic hose or a metal-fabric hose via which the fluid, for example, the medication liquid, is guided in a closed manner so that a corresponding "outlet end" is directed, for example, in the direction of the medication vial and/or the draw-up vial and serves to discharge the fluid, in particular to discharge the fluid in a controlled fashion.

A "stowed position" here refers to a position of the transfer hose and/or the outlet end in which a basic position is reached in which, for example, corresponding port doors can be securely closed. This is, for example, the position in which the transfer port arrangement or the transfer port is located in order to transfer the entire arrangement to a safe and sterile permanent state.

A "removal position" is in contrast a position in which the outlet end and/or the transfer hose is or are, for example, pulled out of the passage and thus passed through the passage plane so that the outlet end can then be manipulated in the removal position outside the passage and the fluid can be transferred via the transfer hose via the outlet end through the passage, for example, into the aforementioned draw-up vial.

An "elastic spring element" is a technical component that can provide a corresponding spring force by absorbing elastic energy in order to return from a tensioned position to a partially relaxed or fully relaxed position. Such elastic spring elements are known, for example, as material springs, as compressed air springs, or in a variety of ways with the same effect. The elastic spring element is elastically pretensioned in the removal position and releases at least part of its stored working capacity in the direction of the stowed position so that the elastic spring element pulls the transfer hose back from the removal position into the stowed position when the transfer hose and/or the outlet end are accordingly released or partially released.

In this context, the transfer hose assumes certain shapes in the stowed position according to the present invention, in particular shapes predetermined by its configuration. "Spiral" here refers to a rotating and/or circumferentially adjacent, spiral-like course of the transfer hose, in particular of a longitudinal axis of the transfer hose. "Helical" refers to a spiral arrangement which in particular runs in a third dimension, wherein a center axis of the spiral formed is in particular pulled out into a third dimension so that an outer shape similar to a snail shell is created. "Meandering" refers to a back-and-forth course of the transfer hose adjacently to itself and/or in close proximity to itself.

According to an embodiment of the present invention, the elastic spring element can, for example, be guided along the transfer hose and be mechanically connected to the transfer hose, in particular at one or more contact points along a longitudinal extent of the transfer hose. The elastic spring element thus runs completely parallel to the transfer hose and can, for example, also be incorporated directly into the transfer hose or into a jacket of the transfer hose. The transfer hose itself can also serve as an elastic spring element if, for example, an elastic plastics material, which can in particular also be a thermoplastic, is treated during the manufacture of the transfer hose so that the properties of the elastic spring element are provided.

The elastic spring element is in particular arranged in the passage in a spiral, helical, and/or meandering manner, in particular in a spiral, helical, and/or meandering manner within the passage plane.

This arrangement of the elastic spring element with, for example, contact points along a longitudinal extent of the transfer hose provides that the elastic spring element and the transfer hose follow the same or at least a similar path, wherein this is particularly independent of the deformation energy stored in the elastic spring element. If the elastic spring element is shaped in the same way as the transfer hose, this results in further geometric harmonization of the elastic spring element and the transfer hose, so that a particularly safe and reliable stowage of the transfer hose is provided.

The elastic spring element is, for example, a wire-shaped bending spring, wherein the wire-shaped bending spring is in particular made from a spring steel and/or from a stainless spring steel. The elastic spring element can thus, for example, be manufactured directly in the form of a transfer hose or in the form of a portion of the transfer hose and pretensioned or preformed accordingly so as to facilitate assembly.

A "wire-shaped bending spring" in this context is, for example, a spring molded from a wire-shaped spring steel which is then preformed into, for example, a spiral, a helical, or a meandering shape. A "spring steel" is a steel which has a particular hardness but additionally or alternatively a particular elastic deformability so that, for example, a plastic deformation of the elastic spring element, in particular the wire-shaped bending spring, is excluded as far as possible. A "stainless steel" is analogously a corresponding steel, i.e., an iron-based material, which is corrosion-inhibiting or corrosion-free. This is important for a reliable design, in particular in conjunction with hot steam used, for example, for sterilization.

In an embodiment of the present invention, the transfer hose can, for example, have a connection piece at the outlet end, wherein the connection piece enables the transfer hose to be connected to a removal device within the removal area so that the fluid can be transferred to the removal device via the connected connection piece, sealed off from an environment of the removal area.

The connection piece arranged at an outlet end on the transfer hose is used, for example, to enable the transfer hose to be connected to a removal device within the removal area so that, for example, a sterile transfer is possible with the connected removal device on the connection piece.

A "connection piece" is a fluid-mechanical component that is, for example, specifically adapted to a collection vessel and that is assigned to the outlet end in a fluid-conducting manner and enables the transfer hose to be connected, for example, in compliance with sterile specifications. Such a connection piece can, for example, be designed as a plug-in nipple with a needle or with analogously acting elements.

"Sealed off from an environment" in particular means that the transfer of the fluid is protected against unwanted external influences such as contamination, ingress of foreign substances, or the like.

The passage can be closed, for example, via a port cover which is arranged on the passage and which can in particular be pivoted, wherein the port cover in particular has a bayonet closure so that the closed port cover can be moved into a secured position and/or sealed position via the bayonet closure. This means that the port cover can then also be secured and/or sealed or transferred to a secured and/or sealed position.

The expression "can be pivoted" means, for example, the connection via a pivot joint, a hinge, or another pivot element, so that a rotational movement of a "port cover", i.e., a closure for the transfer port, is in particular possible. The port cover is closed, for example, via a bayonet closure, i.e., with an axial insertion and subsequent securing by a rotary movement. A "secured position" here refers to a position in which the port cover is mechanically fixed in the transfer port and mechanically closes the passage, wherein a "sealed position" in particular refers to the sealing closure of the passage, for example, by preventing the ingress of foreign substances and/or bacteria via sealing elements.

If the outlet end, in particular the connection piece, is accommodated in the area of the port or associated with the port on a holder that geometrically corresponds to the outlet end and/or the connection piece, it is easy to remove the connection piece from the holder, for example, when the port cover is open.

A "holder" is, for example, a clamp or a mechanically shaped receiving part in which the connection piece can be accommodated in a geometrically corresponding manner.

The holder for this purpose is, for example, a clamp holder and/or a clip holder for the outlet end, in particular for the connection piece, wherein the clamp holder and/or the clip holder in particular enables a removal of the outlet and/or the connection piece in a direction which is substantially parallel to the passage axis. The holder can also, for example, be guided on a telescopic arrangement so that the holder is pulled out after the port cover has, for example, been opened or mechanically connected to the opening of the port cover and is therefore more easily accessible.

This means that the outlet end or the connection piece can be easily removed manually or robotically, for example, without having to search for the outlet end or missing it. This also provides for secure geometric access to the outlet end, in particular to the connection piece.

In an embodiment of the present invention, the holder can, for example, be mounted on a support device which is arranged in the direction of the fluid reservoir.

Such a "support device", i.e., an additional mechanical device which, for example, connects the holder with the port outlet to a port ring surrounding the port outlet can, for example, be designed as a plastics part which is also arranged directly on the fluid reservoir or is part of a bag for a fluid which can be connected to the transfer port.

In an embodiment of the present invention, the transfer port can, for example, be a liquid transfer port. Such a "liquid transfer port" is a standard and/or standardized port for transferring liquids in a sterile environment, wherein a corresponding bag with a transfer hose can in particular be connected to one side of the port so that the liquid can be removed from an opposite side of the port in accordance with the above-mentioned procedures.

The present invention also provides a transfer system with a fluid reservoir, a receiving area, and a transfer port according to one of the embodiments described above.

Such a "transfer system" has, for example, a port part in which the transfer hose is arranged, as well as a port part which has an acceptance for a corresponding fluid, for example, in the direction of a filling chamber. Such a transfer system can also have other elements, such as pumps, holders, robotic devices or the like.

An appropriate transfer system provides for a reliable transfer of the corresponding fluids in a closed transfer system.

The present invention is explained in greater detail below with reference to exemplary embodiments as shown in the drawings.

A transfer port 101 separates a sterile area 161 from a removal area 163. The transfer port 101 has a round, circular disc-shaped main body 103. The main body 103 forms a passage 106 in a passage plane 105. A hinge piece 109 is mounted on a receptacle 107 on the main body 103 so as to be rotatable about a pivot axis 171 in a pivot direction 173, thereby providing that a cover 111 attached to the hinge piece 109 can be pivoted in front of the main body 103 into the passage 106 and thus serves to close the passage 106.

A closure 113 is attached to the cover 111. The closure 113 can engage in a clip 114 on the main body 103 of the transfer port 101 so that the cover 111 can be fixed in its pivoted position in front of the passage 106. A bayonet 115 is furthermore attached to the inside of the cover 111 on an inner side 112 and can engage in a mutual bayonet mount 116 in the passage 106 and, when the bayonet 115 is rotated within the bayonet mount 116, fixes the cover 111 fluid-tightly in the passage 106.

Inside the passage 106, a hose 121 in the form of a hose spiral 123 is wound approximately parallel to the passage plane 105. A needle 129 is arranged on a connection piece 127 at an outlet end 126 of the hose. The outlet end 126 of the hose is arranged in a deployment position 117 with the connection piece 127. In an open position of the cover 111, the connection piece 127 with the needle 129 is thus accessible so that it can be removed, for example, manually or robotically. The hose is firmly connected to a filler piece 125 within the passage 106, wherein a corresponding fluid from the sterile area 161, for example, from a fluid container, is introduced into the hose 121 through the filler piece 125 and conveyed in the direction of the connection piece 127 in the direction of the needle 129. If the hose 121 with the hose spiral 123 is arranged substantially within the passage plane 105, it is located in a stowed position 181.

If the hose spiral 123 is now pulled along a pulling direction 119 along a passage axis 165 into a removal position 183 outside the transfer port 101, the hose spiral 123 is pulled apart.

A spiral spring 131 is firmly bonded to the hose 121 along the hose 121 in the form of the hose spiral 123 and is guided completely parallel to the hose 121. The spiral spring 131 is shaped analogously to the shape of the hose spiral 123, wherein the spiral spring 131 is substantially relaxed in the stowed position 181 and substantially pretensioned in the removal position 183. If the connection piece 127 with the needle 129 is now released or manually or robotically brought back towards the passage 106, the hose 121 with the hose spiral 123 is automatically pulled back into the stowed position 181, namely, via the elastic energy of the spiral spring 131, so that either when the connection piece 127 is returned and/or also when the cover 111 is closed, the hose 121 can then no longer be trapped inside the passage 106 of the main body 103, but is pulled into the passage 106 via the spiral spring 131.

The hose 121 is made, for example, from a PE or another plastic, wherein in the example shown, the spiral spring 131 is made from a stainless spring steel. The spiral spring 131 can alternatively also be made of a plastic or another metal and/or the hose 121 itself is made of, for example, a largely elastic plastics material, so that the corresponding, for example, thermally induced, pre-tensioning of the hose 121 takes over the function of the spiral spring 131 in the hose 121 itself.

A holder with a clamping device (both not shown) can similarly be arranged in the region of the passage or be mechanically associated with the filler piece 125, into which the connection piece 127 with the needle 129 can be clamped or inserted, so that the connection piece 127 with the needle 129 is presented in a fixed position relative to the transfer port 101. The holder can also be accommodated on a telescopic guide which is, for example, arranged substantially parallel to the passage axis 165, so that the holder is pulled out and presented, in particular coupled, with the opening of the cover 111, for example, to facilitate a robotic removal of the connection piece 127. When the cover 111 is closed, the holder can then slide back into the passage 106, which is further assisted by the elastic pre-tensioning of the hose 121 with the spiral spring 131.

Figure 4:
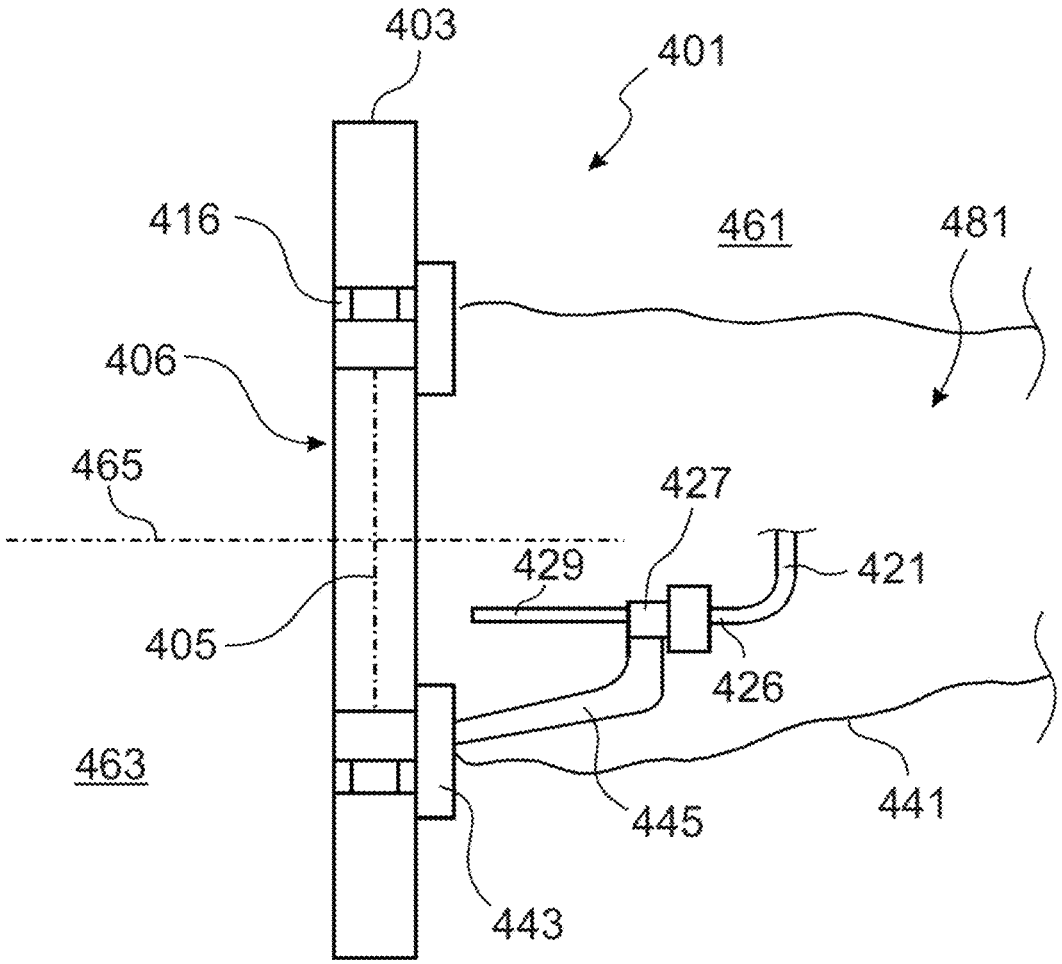
FIG. 4 is a cross-sectional representation of an alternative transfer port with a hose for transferring a fluid.

FIG. 4 shows a transfer port 401 which has the same basic structure as the transfer port 101 shown in FIG. 1. Transfer port 401 has a main body 403 which is arranged in a ring around a passage plane 405 at a passage 406 and forms the passage 406. The main body 403 also has a bayonet receptacle 416 in the direction of a removal area 463, for example, to receive a cover analogous to the transfer port 101 presented in FIG. 1 above. In a sterile area 461 arranged opposite the removal area 463, a connection piece 427 with a function analogous to the connection piece 127 is accommodated in a support holder 445 in a bag 441, which is connected to the main body 403 in the form of a bayonet with a connection ring 443. The support holder 445 is connected on the inside to the connection ring 443 of the bag 441, in particular molded on in an integrally bonded manner, whereby a hose 421 supplying the connection piece 447 at an outlet end 426 is arranged inside the bag 441 and the connection piece 427 is accommodated with a needle 429 inside the bag and also inside the envelope geometry of the connection ring 443. Liquid provided by the hose 421 can thus be conveyed via the needle 429, wherein the needle 429 with the connection piece 427 can be removed, for example, robotically at a fixed position.

A robot (not shown) can, for example, reach along a passage axis 465 through the passage 406, pick up the connection piece 427 with the needle 429, and pull it through the passage plane 405. In a stowed position 481, the hose 441 is pretensioned in a spiral and/or also in a meandering manner analogous to the previous example and is arranged in the bag 441 equipped with an elastic spring element (not shown in detail in FIG. 4). The connection piece 427 can consequently then be removed against the spring force acting on the hose 421 and springs back into the corresponding stowed position 481, so that a defined position is reached for both the needle 429 and the hose 421 after the connection piece 427 has been reinserted into the support holder 445.

The present invention is not limited to embodiments described herein; reference should be had to the appended claims.

LIST OF REFERENCE NUMERALS

101 transfer port
103 main body
105 passage plane
106 passage
107 receptacle
109 hinge piece

111 cover
112 inner side
113 closure
114 clip
115 bayonet
116 bayonet mount
117 deployment position
121 hose
123 hose spiral
125 filler piece
126 outlet end
127 connection piece
129 needle
131 spiral spring
161 sterile area
163 removal area
165 passage axis
171 pivot axis
173 pivot direction
181 stowed position
183 removal position
191 pulling direction
401 transfer port
403 main body
405 passage plane
406 passage
416 bayonet receptacle
421 hose
426 outlet end
427 connection piece
429 needle
441 bag
443 connection ring
445 support holder
461 sterile area
463 removal area
465 passage axis
481 stowed position

What is claimed is:

1. A transfer port for transferring a fluid from a fluid reservoir to a removal area through a passage, the transfer port comprising:

the passage which is arranged in a passage plane, the passage comprising a passage axis which is arranged substantially orthogonal to the passage plane;

a transfer hose which is arranged within the passage, the transfer hose being configured to guide the fluid, the transfer hose comprising an outlet end which is configured to be pulled out of the passage from a stowed position within the passage to a removal position outside the passage so that the outlet end can be manipulated in the removal position outside the passage and the fluid can be transferred through the passage via the outlet end of the transfer hose;

an elastic spring element which is directly mechanically connected to the transfer hose; and a port cover which is arranged pivotably on the passage and which is configured to close the passage, wherein, the transfer hose elastically pretensions the elastic spring element in the removal position and the elastic spring element is at least partially relaxed in the stowed position so that, via the elastic spring element, the transfer hose is pulled back from the removal position into the stowed position when the transfer hose and thus the outlet end is arranged within the passage, and the transfer hose, in the stowed position, is arranged in the passage in at least one of a spiral manner, a helical manner, and a meandering manner via the elastic spring element.

2. The transfer port as recited in claim 1, wherein the transfer hose, in the stowed position, is arranged in the passage in at least one of the spiral manner, the helical manner, and the meandering manner within the passage plane via the elastic spring element.

3. The transfer port as recited in claim 1, wherein, the elastic spring element is guided along the transfer hose and is mechanically connected to the transfer hose along a longitudinal extent of the transfer hose so that the elastic spring element is guided at least partially parallel to the transfer hose, and the elastic spring element is arranged in the passage.

4. The transfer port as recited in claim 3, wherein the elastic spring element is guided along the transfer hose and is mechanically connected to the transfer hose at one contact point or at several contact points along the longitudinal extent of the transfer hose so that the elastic spring element is guided completely parallel to the transfer hose, and the elastic spring element is arranged in at least one of a spiral manner, a helical manner, and a meandering manner in the passage.

5. The transfer port as recited in claim 4, wherein the elastic spring element is arranged in at least one of the spiral manner, the helical manner, and the meandering manner within the passage plane in the passage.

6. The transfer port as recited in claim 1, wherein the elastic spring element is a wire-shaped bending spring.

7. The transfer port as recited in claim 6, wherein the wire-shaped bending spring is formed from at least one of a spring steel and a stainless spring steel.

8. The transfer port as recited in claim 1, wherein, the transfer hose further comprises a connection piece at the outlet end, and the connection piece is configured to establish a connection of the transfer hose to a removal device within the removal area so that, when the connection piece is connected, the transfer of the fluid to the removal device is possible via the connection piece which is sealed off from an environment of the removal area.

9. The transfer port as recited in claim 1, wherein the port cover comprises a bayonet closure which is configured so that the port cover, when closed, can be transferred into at least one of a secured position and a sealed position via the bayonet closure.

10. The transfer port as recited in claim 1, further comprising:

a holder which geometrically corresponds to at least one of the outlet end and to the connection piece, the holder being associated with the passage and being configured to accommodate the outlet end.

11. The transfer port as recited in claim 10, wherein the holder is configured to accommodate the connection piece so that a removal of the connection piece from the holder is possible when the port cover is open.

12. The transfer port as recited in claim 10, wherein, the holder is at least one of a clamp holder and a clip holder for the outlet end, and the at least one of the clamp holder and the clip holder is/are configured to enable a removal of the outlet end in a direction which is substantially parallel to the passage axis.

13. The transfer port as recited in claim 12, wherein, the holder is the at least one of the clamp holder and the clip holder for the connection piece at the outlet end, and the at least one of the clamp holder and the clip holder is/are further configured to enable a removal of at least one of the outlet end and the connection piece in the direction which is substantially parallel to the passage axis.

14. The transfer port as recited in claim 10, further comprising:

a support device which is arranged in a direction of the fluid reservoir, the support device being configured to have the holder be accommodated thereon.

15. The transfer port as recited in claim 1, wherein the transfer port is a liquid transfer port.

16. A transfer system comprising:

a fluid reservoir;

a removal area; and the transfer port as recited in claim 1.

* * * * *